United States Patent [19]

Cooper et al.

[11] 4,368,250

[45] Jan. 11, 1983

[54] DRY TRANSFER OF ELECTROPHOTOGRAPHIC IMAGES OF AN INTUMESCENT ELECTROSCOPIC THERMOADHESIVE TOWER

[75] Inventors: Sidney Cooper, Roslyn Harbor; Ezekiel J. Jacob, Brooklyn, both of N.Y.

[73] Assignee: Ani-Live Film Service Inc., New York, N.Y.

[21] Appl. No.: 112,826

[22] Filed: Jan. 14, 1980

Related U.S. Application Data

[62] Division of Ser. No. 799,476, May 23, 1977, Pat. No. 4,216,283.

[51] Int. Cl.[3] ..... G03G 13/16

[52] U.S. Cl. ..... 430/109; 430/110; 430/126

[58] Field of Search ..... 430/126, 107, 110, 109

[56] References Cited

U.S. PATENT DOCUMENTS

| | | | |
|---|---|---|---|
| 3,924,019 | 12/1975 | Jacob | 430/124 |
| 3,945,934 | 3/1976 | Jacob | 430/138 |
| 4,066,802 | 1/1978 | Clennens | 156/240 |

*Primary Examiner*—John E. Kittle
*Assistant Examiner*—John L. Goodrow
*Attorney, Agent, or Firm*—Arnold D. Litt

[57] ABSTRACT

The subject invention pertains to a dry transfer imaging technique comprising electrophotographic deposition of an image onto the rear side of a carrier sheet, said carrier sheet being further characterized by being adhesive to the image deposited thereupon; contacting said image-bearing rear side of said carrier sheet with an exterior surface and applying pressure to the front side of said carrier sheet, whereby transfer of said image to said exterior surface is effectuated.

The carrier sheets which are adhesive to the deposited image form a part of the invention. In addition, novel colorless toners have been developed which, when deposited upon the image-bearing carrier sheet, enhance the adherability of said image to the exterior surface.

3 Claims, No Drawings

DRY TRANSFER OF ELECTROPHOTOGRAPHIC IMAGES OF AN INTUMESCENT ELECTROSCOPIC THERMOADHESIVE TOWER

This is a divisional application of pending prior application U.S. Ser. No. 799,476, filed May 23, 1977 to Sidney Cooper and Ezekiel J. Jacobs for "Dry Transfer of Electrophotographic Images" which application has now issued as U.S. Pat. No. 4,216,283 on Aug. 5, 1980.

FIELD OF INVENTION

The present invention pertains to a method, product and apparatus for forming an electrophotographic image on a suitable carrier sheet, said sheet forming a novel portion of the invention, and transferring said image, thereafter, to a desired surface where it adheres thereto. This invention is disclosed in Disclosure Document No. 050752 filed in the Patent Office on July 12, 1976 and is entitled: "IMPROVEMENTS IN DRY TRANSFER ELECTROPHOTOGRAPHIC IMAGES PRODUCED XEROGRAPHICALLY AND-/OR ELECTROSTATICALY BY ELECTROFAX PROCESS".

BACKGROUND OF THE INVENTION

There is disclosed in the prior art (U.S. Pat. No. 3,013,917) a method for producing dry transfer of lettering, symbols, indicia, emblems and the like from a substrate sheet to a receptor sheet, by contacting the substrate sheet containing various print, rear side down, with the receptor sheet, and rubbing the substrate sheet, thereby releasing the lettering etc., and transferring the same to the receptor sheet. The substrate sheet may comprise translucent paper, onion skin, films, paper, cellulose acetate and the like. The characters or designs are printed on the rear surface of the sheet, in reverse position as viewed from the rear of the sheet. The rear surface is treated with a release coating to facilitate transfer of the lettering upon application of pressure to the front surface. The patent limits the method by which the ink is applied to the release coated rear surface of the substrate sheet (dry transfer sheet) to: (1) printing in a flat or rotary press; (2) application with a printing brush; or (3) printing with the aid of a silk screen stencil.

The above process has proved to be inadequate in several respects. The process requires huge inventories of typeface because of the many different typefaces which may be required. There are approximately 22,000 different type fonts, not taking into consideration the eight to ten sizes available in each type font, resulting in enormous dealer inventories. The majority of dry transfer sheets are now manufactured by the silk screen method of reproduction which directly encompasses the above problem of large inventories to the dealers. In addition, it has been found that the quality of print which becomes ultimately adhered to the receptor sheet, has been inadequate. In addition, the time required to produce the transfer sheets has proven to be rather extended.

The high cost associated with the above process has led to a need for a dry transfer technique of lower cost and greater overall quality and efficiency, allowing the consumer the flexibility of making his own transfer as needed.

In accordance with the present invention, there is provided a method, product, and apparatus for forming an electrophotographic image on a carrier sheet, said carrier sheet possessing front and rear surfaces, said image being deposited on the rear surface of said carrier sheet. The carrier sheet composition provides a novel part of this invention. Said image preferably possesses a discernible thickness and, accordingly, upper and lower surfaces, and is further characterized by having pressure-sensitive qualities at least on the upper surface, so that when the rear side of the sheet is brought into contact with a desired surface and pressure is applied to the front side of the carrier sheet, such as by rubbing, a substantially complete transfer of said image from the carrier sheet to the desired surface results. The image, when viewed from the rear of the sheet, is in reverse position and, as viewed from the front of the sheet, is in normal reading position. The present invention overcomes the disadvantages associated with dry transfer systems taught in the prior art and provides an efficient and relatively low-cost method and apparatus for accomplishing the transfer of the heretofore mentioned images from one surface to another without the necessity for maintaining extensive inventories of typeface, symbols, logos, trademarks and other indicia. In addition, the invention contemplates the consumer purchasing blank carrier sheets and provides him with the flexibility of providing whatever characters he desires to place on the surface of the carrier sheet, whenever he requires the same.

SUMMARY OF THE INVENTION

The gist of the instant invention relates to a dry transfer technique and comprises the electrophotographic deposition of an image onto a suitable carrier sheet possessing front and rear sides, the said image being deposited on the rear side of said carrier sheet, said image possessing pressure sensitive qualities, so that upon bringing at least a portion of the image-bearing rear side of the carrier sheet into contact with a desired surface and, thereupon, applying pressure to the non-image bearing front side of the carrier sheet, a transfer of the image from the carrier sheet to the desired surface is effectuated.

The image deposition referred to hereinabove may be accomplished by any suitable electrophotographic technique, such as, for example, by the well-known xerographic method, as fully described in U.S. Pat. No. 2,297,691 and by the so-called electrofax method as more fully described in U.S. Pat. Nos. 2,862,815; 2,979,402 and 2,990,279, the disclosures therein being incorporated herein by reference as if more completely set forth herein. See generally, Schaffert, *Electrophotography* (1965).

In a preferred embodiment of the invention to be described in detail hereinbelow, the image is deposited by means of xerographic techniques as described in U.S. Pat. No. 2,297,691 to Carlson and incorporated herein by reference. Thus, such techniques comprise forming an electrostatic image on a carrier sheet corresponding to information to be recorded and forming a pattern of a xerographic toner on said carrier sheet, corresponding to said electrostatic image.

The efficiency with which the image transfer may be accomplished in this embodiment is related, in part, to the nature of the carrier sheet; the composition of the toner which is utilized to produce the image; and the thickness of the image produced on the carrier sheet.

The carrier sheets are characterized by possessing abhesive qualities vis-a-vis the image produced thereupon. Accordingly, and in contradistinction to the generally desired goals in xerographic and electrofax printing, to wit, irremovable adhesion of the image to the substrate, there is now generated, by virtue of the process of this invention, an image which, by virtue of its composition in conjunction with the unique nature of the carrier sheet, itself, is removable from its substrate, i.e. the carrier sheet.

The unique properties of the carrier sheet may, in one embodiment of the invention, be obtained by coating a substrate surface with an abhesive coating, i.e. coating which is abhesive towards the xerographic toner deposited thereon, by any suitable method, such as, for example, by the well-known process of xerography, as more fully described in U.S. Pat. No. 2,297,691.

The abhesive or releasing coating may comprise any suitable material or combination of materials which impart the desired abhesive qualities to the carrier sheet. The coating, in one embodiment of the invention, may comprise one or more (in combination) of the following materials:

a. Fatty acids, such as Stearic acid, Oleic acid, Coconut oil fatty acids, mixed Castor oil fatty acids, ricinoleic, Azelaic acid, Suberic Acid, pellargonic acid.
b. Fatty alcohols, Oleyl alcohol, myristyl alcohol.
c. Fatty acid esters, notably polyvinyl stearate.
d. Metathenic soaps of fatty acids; calcium stearate, barium laurate, Barium-cadmium soap of Lanolin fatty acids.
e. Metallic complexes of fatty acids, such as sodium stearate, potassium oleate, Sterato-chromic Chloride ("Quinlon" made by DuPont) (Chrome Complex).
f. Organic complexes of Silicon such as poly alkyl siloxanes such as G.E. 2054 mixed with 2055C catalyst made by the General Electric Company, Schnectady, New York, "Silicone" emulsions, solutions and waxes as sold by Dow-Corning.
g. Hydrocarbon waxes.
h. vegetable base waxes such as hydrogenated castor oil.
i. Glycols and polyglycols such as "Carbowax" (Union Carbide Corp.) and polyethylene-glycol-Laurate.
j. Synthetic slip-agents such as the halo carbons and fluorocarbons, their polymers and co-polymers. As to the mode of application or incorporation of the release agents (abhesive agents) to the substrate, any convenient mode of application may be used, including, saturation and surface coating.

In another embodiment of the invention, a substrate may be selected which is inherently abhesive, (sui generis), towards the deposited toner image, such as, for example, polyethylene, polypropylene, polyamides, polyfluoro-carbons, proteinaceous films, polyvinyl alcohol, regenerated cellulose films, any pellucid material, and the like.

The substrate which comprises the carrier sheet may consist of any suitable surface which may be utilized in the xerographic process and includes:

1. Fibrous sheets of natural fibers such as cellulose, silk, hemp, abaca or synthetic fibers such as nylon, dacron, acrylic polymers, glass.
2. Woven and non-woven fabrics preferably somewhat transparentized by coating or saturating with a film-former having a refractive index close to the refractive index of the fabric being transparentized. Generally polystyrene resin or a thermoplastic acrylic polymer such as a methyl-methacrylate or a butyl methracylate polymer.
3. Non-fibrous sheets such as vellum, parchment, "synthetic paper" (reputedly a clear or translucent plastic film) as witness the "synthetic paper" sold by the Union Carbide Corp., New York City, N.Y.

The image which is deposited upon the carrier is the product of the well-known process of Carlson U.S. Pat. No. 2,297,691. The general thickness of the image will range from 0.00001 to 0.015 (0.00015) inches, preferably from 0.000025 to 0.005 inches and most preferably will be thicker than 0.005 (0.0005) inches, i.e., a raised xerographic image having thickness and body with cohesiveness simulating the image deposited by a silk-screen process.

Generally, the thicker the image, the more facile the transfer. In the broadest embodiment of the invention, as it applies to the xerographic method, any conventional toner composition may be utilized such as that presently available in xerography, including, e.g. the Xerox toner made by the Xerox Corp., Rochester, N.Y. especially Toner 660, Toner 813, Toner 914, Toner 2400, Toner 3600-3, Color Toners I.B.M. Toner for Copier 2:
Hunt Chemical Company, Palisades Park, N.J.
Toners for various copiers:
Imaging Systems, Inc., Latrobe, Pa.
Nashua Corp., Nashua, N.H.
Van Dyck Research, Whippany, N.J.
Eastman Kodak Inc., Rochester, N.Y.
Dennison Mfg. Co., Framingham, Mass.
A. B. Dick Inc., Chicago, Ill.

The nature of the specific toner is dependent upon, in part, the particular model and make of xerographic machine utilized. However, the thickness of image obtained with conventional toner will only range between 0.00001 and 0.00005 inches depending on the substrate. It is preferable, when using such conventional toner, to enhance the thickness of the image by any suitable means such as by repeated copying onto the same image from the same subject matter. This method of multiple copying to densify the image is taught in U.S. Pat. No. 2,955,935 to Walkup, the disclosures therein being incorporated herein by reference.

In a less preferred embodiment of the invention, the need for multiple pass-through using conventional toner may be obviated by incomplete fusion and thermoadhesion by varying the heat settings in the copiers so that less heat is available for the fusion of image to substrate. Accordingly, the releasability of the image is enhanced, thereby eliminating the need for thick imaging, as for example, by the Walkup technique, supra.

In another embodiment of the invention, a toner composition has been developed which achieves the desired density and thickness parameters for facile transfer of image from the carrier sheet of this invention to the receptor surface. The toner composition and method for its formation are set forth in U.S. Pat. No. 3,924,019 and U.S. Pat. No. 3,945,934, to Jacob, the teachings therein being incorporated herein by reference. In essence, the toner composition comprises a stable, dry, free-flowing, self-contained intumescent electroscopic powder mixture including a thermoadhesive agent, a pigment and a dry intumescing agent being comprised of plastic microspheres containing occluded gas there within at ambient temperatures and being expandible in size upon being subjected to elevated temperature. This expandibility concept has been referred to as "raised xerographic printing".

The above toner preparation comprises the steps of (a) producing an electrostatic latent image on a xerographic member, (b) contacting said member with a dry, free-flowing, self-contained intumescent electroscopic toner mixture to develop said electrostatic latent image, (c) transferring the distributed toner from said member to a transfer surface and (d) subjecting said transferred toner to heat sufficient to cause intumescence thereof and thereby provide a raised image on said surface.

As already noted, supra, the image which is formed on the carrier sheet possesses pressure-sensitive, adherable properties, at least on its top or upper surface, i.e., the surface which is not in contact with the carrier sheet, thereby enhancing the adherability of said image to an exterior or desired surface (receptor surface) brought into contact with said image. The pressure-sensitive property, referred to supra, may be obtained in any suitable and convenient manner such as by: post-coating of the image after it is formed on the carrier sheet; utilizing a novel toner composition to form an image possessing the desired pressure-sensitive qualities; or admixing aerosol and/or powder cloud toners, as described in Schaffert, *Electrophotography* (1965) at pp. 157, 307–309, 362, 373, 378, with the novel pressure-sensitive compositions of this invention. The above techniques are more fully detailed in the examples set forth hereinbelow.

The post-coating of the image may be obtained in any suitable manner such as by applying the adhesive coating to the image alone or to the entire image-bearing surface of the carrier sheet, the adhesive coating comprising, in one embodiment of the invention, a wax in combination with a tackifying resin, preferably in liquid suspension. The liquid is a solvent or an emulsifying liquid plus bridging solvent. The liquid must not be a solvent for the thermoadhesive material contained in the toner, otherwise the image will be dissolved or attacked, thereby losing its integrity. Thus, for example, tackifying resin can be shellac, and the wax can be "Carbowax" (Union Carbide Corp., New York City, N.Y.). The shellac and the "Carbowax" are dissolved in denatured alcohol. The denatured alcohol, used as solvent, will not attack most xerographic images and is very suitable for making up a tackifying solution.

The post-coating of the image may be achieved non-xerographically, i.e. outside of the photography machine, by any suitable application technique known in the art.

The coating may also be applied, xerographically, over the entire image and carrier sheet, utilizing the novel compositions of this invention, by xerographically copying an overall black pattern onto the image-bearing surface of the carrier sheet. This serves to distribute the pressure-sensitive adherable coating uniformly over the entire surface of the carrier sheet. In another embodiment, the coating may be applied only to the visible and palpable xerographically produced image (and not to the sheet itself) by using the same master sheet from which the image was first produced (using the conventional colored toner). In yet another embodiment, the master sheet will comprise the same image configuration as that on the carrier sheet but will be slightly larger in area than the image on which it will be superimposed. This insures substantially complete coverage of the image with the clear adhesive coating, which, in turn, facilitates substantially complete adhesion of the image to a receptor surface brought into contact with said image. In these embodiments, two "toner" depositions are required, one, with conventional toner, to produce the visible image upon the carrier sheet, and the second, with the novel compositions of this invention, to produce the pressure-sensitive coating.

The adhesive composition which is applied xerographically includes most thermoadhesive unpigmented particulate matter having a melting point below 300 degrees F.. They may consist of waxes and/or polyethylene in micronized form such as "Polymekon" and "Mekon" sold by Western Petrochemical Inc., Chanute, Kans., various polyethylenes, polypropylenes, and Fischer-Tropsch waxes.

While it is preferred that the adhesive composition be liquid, it may, alternatively, be applied in a powder form which, upon application of heat, fuses into an adherent film. As above in the case of the liquid adhesive, the powder may be applied either xerographically or non-xerographically. These powders are generally referred to as thermoadhesive substances.

In another embodiment of the invention, the necessity for passing the carrier sheet through the xerographic copier twice may be avoided by use of the novel toners of this invention, which are adhesive "sui generis".

By way of background, the conventional toner compositions comprise relatively high-melting thermoadhesive resins which generally exhibit melting points of around 248° F.. The resins or resin blends contain a pigment, such as carbon black, to generate a visible image on the image-receiving surface. Carlson's toner (U.S. Pat. No. 2,297,691) was powdered asphaltum. Modern toners comprise natural or synthetic thermoplastic resins, such as wood rosin, its esters and derivatives, polyterpenes, cumarone-indene resins, styrene polymers and co-polymers, acrylic resins and the like. They are all thermoplastics. See, for example, Schaffert, *Electrophotography* at pp. 46–48.

The modified toners which are used in this embodiment of the invention possess lower melting points, relative to the conventional toners, and are generally tacky at room temperature. These modified toners have inherent adherability. When formed into an image on a suitable carrier sheet, said image acquires an adherable upper surface.

In general, the modified toners comprise free-flowing conventional toners with additives that lower their melting points. A typical conventional toner may be made as follows:

| CONVENTIONAL TONER: (PART A) | |
|---|---|
| Low M.P. Polystyrene Resin "PS3" Dow Chemical Co., Midland, Michigan | 100 grams |
| Carbon Black, Monarch #71 from Cabot Corp., 125 High Street, Boston, Massachusetts, 02110 | 11 grams |
| Processing aids, free-flowing agents, depolarizers, and the like (generally in the trade secret category) | 4 grams |

To make the adhesive toner a small amount of plasticizer is added, as follows:

| ADHESION PROMOTING ADDITIVES: (PART B) | |
|---|---|
| B.1 | Butyl Benzyl Phthalate |

-continued

| ADHESION PROMOTING ADDITIVES: (PART B) | |
|---|---|
| B.2 | Paraffinic Oil Sunpar 110 Sun Oil Co., Philadelphia, Pennsylvania |
| B.3 | Solid Plasticizer Camphor |
| B.4 | Solid Plasticizer Di-cyclohexyl Phthalate |
| B.5 | Solid Plasticizer "Santolite" MHPor i-H Monsanto Chemical Co., St. Louis, Missouri |

Generally lesser amounts of liquid plasticizers are needed to achieve the same plasticizing efficiency of higher amounts of solid plasticizers. The following ratios are preferred:

| | |
|---|---|
| ADHESIVE TONER NO. 1 | |
| Conventional Toner, Part A | 100 grams |
| B.1 from Part B | 2 grams |
| ADHESIVE TONER NO. 2 | |
| Conventional Toner Part A | 100 grams |
| B.2 from Part B | 5 grams |
| ADHESIVE TONER NO. 3 | |
| Conventional Toner Part A | 100 grams |
| B.3 from Part B | 12 grams |
| ADHESIVE TONER NO. 4 | |
| Conventional Toner Part A | 100 grams |
| B.4 from Part B | 30 parts |
| ADHESIVE TONER NO. 5 | |
| Conventional Toner Part A | 100 grams |
| B.5 from Part B | 50 grams |

The addition of Part B to Part A may be accomplished in any convenient manner, of which two methods are preferred:

| | |
|---|---|
| First Method | Melt and mix into the composition of Part A prior to cooling and pulverizing, thus creating a plasticizer containing toner of homogeneous particles, each particle of the same chemical composition |
| Second Method | Physically blend Part B with Part A particles thus producing a two component blend. Homogeniety will be achieved later on after the image has been formed xerographically and heated in the normal operation of the xerographic copier, said heating serving to melt the two components by flowing them together in the molten condition. |

It must be recognized that the lower the melting point of toner, the more difficult it is to deposit xerographically due to poor flowability properties and a tendency to pack down.

Accordingly, as another feature of this invention, the novel toners are preferably refrigerated in a special developer housing maintained within the photocopy machine. The housing is designed to maintain the tacky toner at a temperature which is low enough to permit substantial flowability of said toner.

In another embodiment of the invention, the toner may be refrigerated outside of the photocopier and then, immediately before use, inserted into the developer housing of the photocopier.

In an effort to alleviate the necessity of refrigerating the toner, the invention also perceives the use of a composite two component toner which is not tacky at room temperature but becomes tackifiable at elevated temperatures, such as experienced during the fusion of the toner onto the carrier sheet. The composite comprises conventional toner and a paraffin wax emulsion which is intimately incorporated into the toner, presumably as a discrete coating on the individual toner particles. This incorporation may be achieved in any convenient manner including spraying the emulsion into the toner in a suitable blending container then drying to a free-flowing state. For the dry free-flowing xerographic toners mixing is carried out dry or moist with a non-solvent menstruum which has negligible solvent action on the toner. For Electrofax toners, which are liquids containing particulate material and solvents, the mixing is effected in the solvent, which is generally an isoparaffinic liquid. The isoparaffinic liquid has negligible solvent action on most of the adhesive additives. In the present invention, Fischer-Tropsch Waxes, Stearone & Laurone (Argus Chem., Brooklyn, N.Y.) Micronized polyethylene, foammable microspheres of Jacob U.S. Pat. No. 3,924,019 and Jacob U.S. Pat. No. 3,945,934, all can practically and satisfactorily be used in the solvents of isoparaffinic liquid toners.

The waxed toner particles are then used as the toner in a conventional photocopier, without the necessity of refrigeration. While the exact mechanism is not known, it is speculated that the waxy coating liquifies during the fusion operation and forms a coating on the deposited image which is characterized by being adhesive to an exterior or receptor surface brought in contact therewith.

In a further embodiment of the instant invention, a unique xerographic toner has been prepared, in part by the process of Jacob as it is taught in U.S. Pat. No. 3,924,019, the disclosures therein being incorporated hereby by reference. The starting composition comprises the foammable microspheres taught by Jacob in combination with conventional toner yielding an intumescent toner. Low melting, free-flowing, powdered waxy material is combined with this composition.

Prior to fusion, it is speculated that the toner and foammable microspheres are enveloped in the wax. After fusion, at least a portion of the foammable microspheres have "exploded" or otherwise expanded in volume.

The composition so formed is then used as toner in a conventional photocopier. A more detailed discussion of the novel features of this toner composition is set forth in the examples appearing hereinbelow. Suffice-it-to-say, the resulting image on the carrier sheet is raised and of appreciable thickness and densification. In addition, the image shows a substantial affinity for an exterior surface when the latter is brought into contact with said image and pressure is applied to the non-image bearing side of the carrier sheet.

Other novel aspects of the invention are more fully understood in the context of the examples set forth hereinbelow.

As indicated above, the novel features of the invention encompass any electrophotographic image-producing process including the electrofax process. This process provides a photoconductive layer consisting of zinc oxide pigment in a resin binder, bonded to a paper backing. This medium serves both as the photosensitive surface and as the finished print after development and fixing. Thus, the combination of photo-conductor and paper become a consumable item, as contrasted with the "xerox" process in which the photoconductive layer, usually amorphous selenium, is a reusable item and a replaceable component of the copying machine. See, generally, Schaffert, *Electrophotography* (1965) at 18.

In the instant invention, a novel photoconductor is prepared comprising, preferably, a binder and photoconductive particles such as zinc oxide (or non-particulate photoconductors such as solutions, suspensions and emulsions). The conventional binder resin is now made novel by imparting abhesive qualities to it, so that the electrofax photoconductor will itself have abhesive qualities.

Removal of the dry image is impossible from a conventional electrofax copy for the purpose of making a dry transfer. When such an image is removed, it takes with it the white zinc oxide coating into which it has been firmly embedded. A removable and transferrable electrofax image was never desired nor invented. According to the present invention, a separator stratum is interposed between the photoconductor and the deposited image. The separator layer must not be soluble in the liquid toner. Thus, most liquid toners contain isoparaffins as the solvent. The isoparaffins will not attack or dissolve a separator layer consisting of an abhesive substance such as Stearone or Laurone (Argus Chemical Co., Brooklyn, N.Y.) Syloff (Dow Chemical, Midland, Mich.) or Calcium Stearate. Accordingly, an electrofax conductor is prepared for the instant novel purpose of dry-transfer by coating thereon a thin layer of Stearone, Laurone, Syloff, Calcium Stearate or the like. The photoconductor is then used in the conventional manner to receive an electrophotographic image. This image will now be removable. In order for the image to be transferrable by dry-transfer, the image forming particles are made by combining a thermoadhesive resin with the pigment. Conventionally, the pigment is substantially pure carbon black which is not thermoadhesive. Accordingly, a powdered wax is admixed with the pigment-containing liquid toner as follows:

| | |
|---|---|
| Liquid Toner | 100 grams |
| Powdered Polyethylene Microthene (U.S.I., New York City, New York) | ½ gram |

The quantity may be varied to secure any desired adherability. Instead of powdered polyethylene, other powdered thermoadhesives may be used, and the quality of adherability will thusly be varied. Unlike the requirements of Xerography for a relatively high melting powdered adhesive, we can use lower M.P. powdered adhesives for the wet toners. Thus, powdered fatty acids as low as C12 fatty acid can be used. The use of lower m.p. adhesives will permit adherability of the transferred image with less rubbing and less burnishing pressure. Alternatively and preferably, the pigmentary substance in the liquid toner could be a single component pigment, consisting of a pigmented thermoadhesive substance. Pigmented polyethylene made according to Lerman, et al. U.S. Pat. No. 3,586,654 is preferred.

The carrier sheets of the instant invention have also found utility in other processes relating to the dry transfer field. At present, the consumer (user) must purchase his/her type, symbols, logos, etc. from their particular source of supply, mainly art material stores.

These stores are now overloaded with type inventory (dry transfer sheets). There are 24,000 different typefaces in approximately 16 sizes for each typeface. The standard typefaces such as the helveticas, caslons, romans, commercial scripts, old english, etc. are probably the largest selling item in a dealer's store. Many, times, a consumer runs out of a particular letter and must thereby purchase more transfer sheets, and in many instances, the dealer has to wait until his stock is replenished to supply his accounts, meaning that the dealer cannot order too many of any one kind otherwise he would be stocked to the ceiling.

To take care of the above problem, chemically treated transparent sheets are provided. These sheets initially are similar to the carrier sheets referred to hereinabove. These sheets may be pellucid films or paper.

The sheets are chemically treated with a non-photographic coating, such as a resin coating and may be pigmented. A master sheet is placed into close proximity of the carrier sheet in a contact or volume frame. The master sheet comprises a film positive consisting of typefaces, logos, symbols and the like.

The master sheet and carrier sheet are then irradiated by a suitable source of energy which may comprise light (ultra violet, fluoroescent); laser energy; x-ray and the like. The irradiation activates those chemically-treated areas of the carrier sheet which are not covered by the image appearing on the master sheet, resulting in a chemical or physical change in the exposed areas of the contact sheet. The unexposed areas (those areas covered by the master sheet image) remain unchanged and, accordingly, become an identical copy of the master sheet image. The non-photographic coating preferable includes an adhesive component so that the formed image on the carrier sheet is adhesive at least on its upper surface. In addition, the untreated carrier sheet is abhesive to the formed image so that, upon contacting the exposed carrier sheet with a desired surface, image down, and rubbing or burnishing the opposite side of the carrier sheet, a substantially complete transfer of the image to the desired surface takes place.

Thus, the image-bearing carrier sheets formed by this technique, are substantially the same as those prepared by the electrophotographic process already defined.

DESCRIPTION OF THE PREFERRED EMBODIMENT

The preferred embodiment is set forth in the following example.

EXAMPLE 1

An image was produced xerographically in such a way as to have very poor attachment to the substrate. Because of this poor attachment the image could be removed and transferred to a surface which was placed in contact with such image.

Removal and transferrence was effected by vigorous rubbing, in the manner used in the dry-transfer lettering art. Dry transfer lettering is taught in U.S. Pat. Nos. 2,501,495 2,588,367 2,611,313 2,626,226 2,777,781 3,013,917.

Poor attachment to the substrate was achieved by coating the substrate with an abhesive coating, i.e. a coating which would be abhesive towards the xerographic toner which was deposited thereon by the well-known process of Xerography. The process of Xerography is described in Carlson, U.S. Pat. No. 2,297,691.

The abhesive coating consisted of: (either one or more in combination)

a. Fatty acids, such as Stearic acid, Oleic acid, Coconut oil fatty acids, mixed Castor oil fatty acids, ricinoleic; Azelaic acid, suberic Acid, pellargonic acid.

b. Fatty alcohols, Oleyl alcohol, myristyl alcohol, cetyl alcohol.

c. Fatty acid esters, notably polyvinyl Stearate d. Metathenic soaps of fatty acids; calcium stearate barium laurate, Barium-cadmium soap of Lanolin fatty acids.

e. Metallic complexes of fatty acids, such as sodium stearate, potassium oleate, Sterato-chromic Chloride ("Quilon" made by DuPont).

f. Organic complexes of Silicon such as poly alkyl siloxanes; e.g. G. 2054 mixed with 2055C catalyst; "Silicone" emulsions, solutions and waxes as sold by Dow Corning.

g. Hydrocarbon waxes.

h. Vegetable based waxes such as hydrogenated castor oil.

i. Glycols and polyglycols such as "Carbowax" (Union Carbide Corp.) and polyethylene glycol laurate.

j. Synthetic slip-agents such as the halocarbons and fluorocarbons, their polymers and co-polymers.

As to the mode of application or incorporation of the release agents (abhesive agents) to the substrate, any convenient mode of application may be used, including, saturation and surface-coating.

Instead of using a substrate with an abhesive coating, a substrate may be selected which is abhesive towards the deposited toner by its very nature. An abhesive substrate, sui generis, may include, polyethylene, polypropylene, polyamides, polyfluoro-carbons, proteinaceous films, polyvinyl alcohol, regenerated cellulose films, and the like.

EXAMPLE 2

In this example, it was desired to increase the density, covering power, coherence and opacity produced in Example 1 of the image in order to improve its transferability. Therefore the image was increased in thickness by repeated copying on to the same image from the same subject matter. With each copying operation, the thickness of the xerographic print was increased by about three tenths of one thousandth of an inch (0.0003"). After a thickness of 0.0015" was attained, the thickness of the toner deposit was satisfactory for transferrence. This method of multiple copying to densify the image is shown in Walkup, U.S. Pat. No. 2,955,935. In this example a sheet of polyethylene terephthalate ("MYLAR") about five thousandths of an inch thick (0.005") was repeatedly fed through a Xerox copying machine for multiple impressions of the subject matter superimposed upon each other. The Xerox copier used was a No. 4000 which is well suited for multiple copies, due to the fact that a given copy can be repeatively fed into the machine to receive subsequent impressions.

EXAMPLE 3

To attain a greater degree of image clarity vis-a-vis Example 2 product, the raised xerographic printing process was used wherein a thick image is produced in but a single pass through the xerographic copier. Raised Xerographic printing is described in Jacob, U.S. Pat. Nos. 3,924,019 and 3,945,934. In this example, 100 volumes of a commercially available Xerox Toner, 8 volumes of foamable microspheres were added. By using the appropriate toner for a particular Xerox model machine, and by simply therein adding the foamable microspheres, raised copies were obtained (0.003" thick) immediately upon use, without any need to adjust the heat in the fusing section, the exposure time, the dwell time and other variables. Other compositions of intumescent toners are taught by the '019 disclosures and these can be used at any intended temperature depending upon the thermal stability of the carrier sheet selected. These intumescent toners may or may not liberate a gas upon heating, but in every case they attain great expansion. Foamable microspheres are made by the Dow Chemical Co. of Midland, Mich. It is a powder composed of vinylidene chloride-acrylonitrile-isobutane having a particle size of about ½ to 20 micron with an average of 8 microns. This powder is electroscopic. The characters so produced were very sharp and the background very clean. Magnified 25 times the characters imprinted showed a well packed raised structure having a grained appearance rather like many brown to black balloons closely compacted together instead of the usual Xerox characters which have a molten and solidified flowed lava like appearance with fissures, cracks and dusting. The thickness of the print was 0.003" s indicated, upon transfer to the receptor surface, yet by pressing and rubbing, the thickness shrank down to 0.0015" with increase in the density and coverage, probably due to the initial low density of the raised Xerographic print, initially. The substrate used was a vellum which has a surface coating of a well-known abhesive material "Quilon C" made by DuPont.

EXAMPLE 4

A substrate was used without any abhesive coating. A xerographic print was made thereon, but the print was not completely fused and thermoadhesively attached. This incompletely-fused print could be transferred to a receptor surface by vigorous rubbing and pressure. To prepare an incompletely fused print, it was necessary to alter the heat settings within the Xerographic copier. In some copiers this is not possible. In working with the Xerox 813 copier and the Xerox 660 copier, the result was achieved by using a substrate that was two or three times the thickness of the substrate which is normally used for firm thermoadhesive attachment of the print. The heavier mass of material in the substrate, with its higher specific heat, absorbed much of the heat available in the copier, leaving insufficient heat for adequate fusion of the print. This inadequately fused print could be transferred to a receptor surface.

EXAMPLE 5

In order to facilitate transferrence of the image from the carrier sheet to the receptor sheet, the surface of the image as it rested on its abhesive substrate was given an adhesive coating. This adhesive coating serves to wet the surface of the receptor tenaciously with very little pressure and rubbing. The adhesive coating sticks firmly to the receptor and pulls off the xerographic print away from its abhesive substrate for firm attachment to the receptor.

The adhesive coating used was a wax plus tackifying resin as in U.S. Pat. No. 3,013,917 in solvent suspension. Both natural and synthetic waxes may be used. Solvents used in the adhesive coating tend to damage a xerographic print. A xerographic print is based on a styrene resin, or a styrene acrylic resin which is readily soluble in solvents.

Therefore, in order to minimize solvent attack, it has been found that a water dispersion of the adhesive agents used in the coating over the print, is most desirable.

For a xerographic print made with Xerox 813 toner which is based on styrene acrylic resin, a suitable coating is an acrylic pressure-sensitive adhesive in aqueous emulsion. In this example, nine parts of Rohm and Hass Latex # HA8 and one part of Rohm and Haas Latex HA-12 were used. The mixture was diluted with water to about 400 cps., sprayed onto the xerographic print and allowed to dry.

A dry transfer xerographic print made as above will transfer readily to a receptor surface and peel away the print from the carrier very cleanly and rapidly. A minimum of rubbing and pressure are needed to produce the desired effect.

EXAMPLE 6

The dry transfer sheets made as in Example 5 may tend to block when the sheets are arranged into fairly low piles. Therefore, the substrate was coated with an abhesive coating on both its front and back surfaces. The front surface served as the abhesive substrate for the xerographic print (image), while the back surface acted as a releasing liner to free adhesive coated surface of the sheet that lay in contact with it. Thus, the blocking could be minimized for all but the severest conditions of shipping and storage.

EXAMPLE 7

The adhesive coating in Example 6 was replaced by a colorless powder coating applied, preferably, xerographically or by any other powder-coating method, such as, e.g., fluidized bed. The powdered thermoadhesive material used was a low melting Ethylene-vinyl acetate co-polymer sold by U.S.I. division of National Distillers, under the trademark "Microthene".

After the powder coating was applied, heat was used to fuse the powder into a film that was adherent.

EXAMPLE 8

The xerographic application of a colorless powdered thermoadhesive substance as in Example 7 was modified so that the deposit of the adhesive powder occurred only on the print areas. This was effected by using the same master sheet from which the original xerographic print was made and by making a second copy thereof on the original xerographic print, utilizing as "toner" the colorless particulate thermoadhesive powder.

EXAMPLE 9

In order to overlap the outline of the printed character with adhesive, the master sheet comprised an image of slightly larger area than that of the print which was to be covered.

EXAMPLE 10

In order to obviate the need for two passes of the carrier sheet through the xerographic copier (one for the print, and one for the overlay of adhesive) a toner was devised which would be adhesive "sui generis" (by its very nature).

While the toners used in Examples 1–4 were unmodified xerographic toners of a relatively high-melting thermoadhesive resin, the toners used in this and following examples are lower melting and can be transferred without excessive pressure and frictional heat. Conventional toner resins melt at 120° C.

The following formula was used. The toner resulting therefrom was lower melting, and could be ground into a fine electroscopic powder 5 to 20 microns.

| | |
|---|---|
| Cumarone-Indene resin 60° C.M.P. | 100 grams |
| Carbon Black, Monarch 71 | 10 grams |
| Zinc Stearate | 2 grams |
| Santocel (Monsanto) a silica aerogel | 3 grams |
| Beeswax | 1 gram |

The above composition was dispersed at 100° C., then cooled and ground. This toner could be transferred from its substrate with less rubbing and pressure than was needed in the conventional 120° C. toners in Examples 1–4.

EXAMPLE 11

In order to achieve facile transferrence of the image, a toner of low melting point was tried. The resin used was a 40° C. melting point polystyrene (Hercules Co.) instead of the 60° C. resin used in Example 10. This toner has a tendency to pack down and not flow freely in the manner of an electroscopic powder. Therefore, it was refrigerated to 0° C. and dispersed in the developer of the Xerox Model 813 which also had been pre-cooled to 0° C. The entire developer housing with the developer in it was removed from the Xerox 813 and placed in the refrigerator overnight prior to use.

EXAMPLE 12

In this example a two component toner was utilized. This composition results in a pressure sensitive print from the Xerox copier, without the need for using a low melting toner which must be stored and used below room temperature and which also requires refrigeration of the developer and the developer housing, as in Example 11. The composition used herein was:

| | |
|---|---|
| Xerox 813 Toner | 100 grams |
| Paraffin wax emulsion - Dura-Commodities Corp. Paraffin Wax Emulsion S-9 | 10 grams |

The emulsion was sprayed into the toner while it was being mixed. The ideal way to do this is in a Patterson-Kelley double cone mixer with intensifier bar. The intensifier bar which is approximately in the central horizontal axis of the tumbling toner, is provided with a series of perforations or nozzles. These perforations are used as the outlet of a pressure-fed stream of Paraffin wax emulsion. The fine emulsion droplets are slowly and evenly incorporated into the toner. Thereafter a stream of dry air is sparged across and through the tumbling Toner until the volatiles have been removed. The waxed toner particles are then used as the Toner in the Xerox 813. In the copying process, it is speculated that while the toner is being fused on to the carrier, the waxy envelope surrounding the toner melts and liquefies. The liquified wax then, (it being incompatible with and substantially incapable of remaining in solution with the toner at room temperature) will form a coating on the deposited image. Furthermore, some of the liquefied wax coating will spill over the boundaries of the image and make contact with the abhesive coating on the substrate. Where the coating on the substrate comprises a compatible wax, as in Example 1G, there will be created in effect a perimeter of wax as an envelope, encasing the image, and protecting its extremities from abrasion and rough handling. This waxy envelope being actually the adhesive which will transfer on to the desired surface, ensures faithful transfer of the extremities of the image.

Where the abhesive coating on the substrate is not compatible with the thusly created liquefied wax coating on the image, there will nevertheless still exist a protective action on the extremities of the image by the wax which had melted and spilled over. Instead of paraffin wax other waxes may be used or combinations of waxes and resins may be used or combinations of elastomer-resin-wax may be used such that the coating created on the image will be of a pressure-sensitive, dry, nature and will adhere to the receptor surface with a minimum of pressure and rubbing.

Of course the amount of waxy coating on the toner particles as given in the starting formulation in this example, can be varied so as to increase the wax coating for those images which are to be transferred to surfaces of greater rugosity than the surface of a sheet of 20-lb. bond paper.

EXAMPLE 13

In this example we have created a novel composition and method for a single-deposition of toner which achieves dry-transfer desiderata, in addition to image density and thickness. In this example a raised xerographic toner such as taught in Jacob, U.S. Pat. No. 3,924,019 is used. We used Example 7 of said patent. Additionally, we tumbled into the formulation, 10 parts of the lowest melting free-flowing powdered waxy material in this case the Ethylene Vinyl Acetate from U.S.I. Any other low melting pressure-sensitive solid material may be used provided it is free flowing in powder form at room temperature. At this state it is speculated that toner and foamable microsphere particles are enveloped in a wax envelope.

After fusion in the Xerox copier, a novel print was produced which was not only raised, but also carried on the microsphere's inflated walls some of the powdered waxy material. Some microspheres were exploded so that the walls had waxy material both within and without the fragments. (Stage 2) The final stage 3 gave a novel product. The print when transferred to the receptor surface showed that the waxy product was re-aligned and re-agglomerated by the rubbing action of the transfer process. Thus was created a surface re-concentration of waxy material, away from the microsphere fragments, a further fragmentation of the microsphere walls with some compaction, and a densification of the image. The densified image was from 0.001" to 0.0015" thick and was a coherent film which could be removed from its abhesive substrate with a pair of tweezers. Thus a thickness of film was achieved which was most desirable for dry transfer images, and comparable to the material now being sold as dry transfer images. See, U.S. Pat. No. 3,013,917. The novel feature is that the step of transferrence is now a functional part of the process of creating a raised xerographic dry-transfer image. It compacts the image, re-distributes the adhesive particles, substantially expels them from the microspheres and microsphere fragments, creates a greater and more effective adhesive surface by re-aggregating displaced wax (adhesive) particles in the vicinity of and in contact with the receptor surface.

A novel feature of the Print when it is in stage 2, the stage in which it is stacked and sold or used, is that the exploded or inflated microspheres in the raised xerographic print provide an anti-block surface so that the sheets do not block upon each other. The surface of the print is multi-planar.

EXAMPLE 14

A novel single particle toner was formulated by utilizing a thermo-adhesive composition, the latter not being usable as a free flowing powder. In effect a "tacky" toner was created, which nevertheless would be free flowing and capable of particulate deposition in a Xerox copier.

| | |
|---|---|
| Wax or incompatible room temp. plasticizer - see below | 100 gm. |
| Natural Rubber (Pale Crepe) | 100 grams |
| Monarch 71 Carbon Black | 10 grams |
| Piccotoner resin (reputedly Styrene-acrylic - Hercules Co.) | 100 grams |
| Shell "Ionol" | 1 gram |

The natural rubber, was broken down for 10 minutes [with Butylated Hydroxy toluene (antioxidant)] on a 10" rubber mill (cool water was run through the mill rolls. After the rubber has been broken down or "masticated" to a Mooney of 55, the water was shut off. This takes about 10 minutes as stated. The Piccotoner resin was added using only frictional heat of the mill. The composition was milled for about 10 more minutes. The Carbon Black and antioxidant were then added and dispersed thoroughly. This takes 10 more minutes. A scraper blade was used on the back roll.

The incompatible drying agent, a wax incompatible at room temperatures was milled in, said drying agent spewing to the surface as a dry bloom. The composition works best with Ceresin Wax 85° C. M.P.. Some waxes sold as antiozonants in tire manufacture also work well.

This composition is very tacky when hot and can only be removed from the mill rolls by using the scraper blade. When cool it is dry and non blocking.

This composition is capable of being air milled under refrigerated conditions to the size suitable for xerographic toners, namely from 5 to 20 microns.

EXAMPLE 15

In Example 13 we propose to use adhesive containing microspheres instead of the foamable microspheres.

These microspheres measure from one micron to 30 microns in diameter. They consist of a liquid core or a tacky balsamic solid core instead of the pure isobutane normally used for foammable microspheres. The encapsulating shell may be of thermoplastic thermoadhesive material such as the shell of the foammable microsphere and it may be dyed or undyed natural material. The encapsulating shell may also be incapable of thermally being softened such as the shell made of gum arabic. The encapsulated tacky material is preferably of low viscosity to facilitate spray drying during manufacture. A higher viscosity balsamic material might equally be used and liquefied by heat during the spray drying step of microsphere manufacture. Suitable tacky liquids are: Polybutene "Indopol" sold by Amoco: Polyterpenes sold by Hercules Co. (Wilmington, Del.) Atactic polypropylene; Wood Rosin oils and derivatives "Hercolyn" "Abalyn" sold by Hercules.

We prefer a composition in which the encapsulating shell will be thermoadhesive, will not be solvated by the contents at ambient conditions but will be solvated by a post heating after xerographic deposition. We prefer therefore a styrene-acrylonitrile shell and polybutene tackifying liquid. This produces a Toner which is dry and free flowing when used in a photocopying machine but becomes tacky when thermoadhesively affixed to the carrier sheet in the Xerographic process. It is a single microsphere which can be used as the sole toner in our process.

EXAMPLE 16

In example 15 we propose to use adhesive containing microspheres as an admixture with foamable microspheres of Jacob U.S. Pat. No. 3,924,019 (Example 7). About 10 to 50 volumes of adhesive containing microspheres would be blended into the self rising Jacob Toner composition.

EXAMPLE 17

We propose to use foamable microspheres which also contain an adhesive, say, polybutene, dissolved in the isobutane (or other similar hydrocarbon) which is encapsulated in said microsphere, in combination with conventional toner. This would be a viable method of securing a raised xerographic print, and "pari passu" create an adhesive coating. It would yield a tacky toner, which is dry and free flowing before deposition on the substrate, and will also result in a raised xerographic print. If the microspheres are also colored, (such as with Carbon Black), then they could constitute the sole toner, which would embody firstly the pigmented thermoadhesive "dry ink", secondly a method for creating a raised xerographic print, and thirdly a source of the dry-transferred adhesive.

EXAMPLE 18

This illustrates another method for creating a tacky surface on a xerographic print prepared as in example 1 and example 3. It involves post-plasticization. After the raised print has been made according to Example 3, a sheet of paper or other carrier is placed upon it. This sheet contains a plasticizer and will function as a plasticizer-donor. We used a 25 lb. glassine very lightly coated with dibutyl Sebacate—about 5 lbs. per ream. This plasticizer migrated into the xerographic print. The presence of the foamed microspheres in the print helped in this migration. The print became tacky on its surface after one week. (This could be accelerated by short heating and pressure). The tacky print could be transferred to the receptor surface very easily compared with control (which is Example 3). Thus, we can use the normal 120° C. toner in the normal raised xerographic printing, and achieve by this novel process the end result of having a tacky surface suitable for dry transfer.

EXAMPLE 19

In this method a xerographic print or image is produced on an abhesive carrier sheet as in example 1, 2, 3. An adhesive donor sheet is placed in contact with the print. This adhesive donor sheet is made of glassine paper—about 15 lbs./ream-coated with a 2 mil. thickness of a blend of Beeswax, 80 parts by weight, and a resin (such as Wood rosin) 20 parts by weight. The two sheets together are passed under an infra red heat source. The black print becomes hot and melts the superposed wax mixture. The wax mixture is thus leached from the donor sheet and becomes part of the surface of the print. The print has thus acquired a dry adhesive coating which will facilitate its attachment to a transfer sheet by the dry transfer method.

Both the following examples use the two novel aspects of the invention namely abhesiveness and adhesiveness to create the invented dry-transfer sheet by the simple expedient of combining both processes into a coating onto a sheet which when copied upon automatically becomes a dry-transfer sheet.

The thusly created transfer sheet has everything included in it so that if it is fed through the conventional xerographic copier operating in conventional manner and printed upon with conventional toner, the resulting product is a dry-transfer image.

The image will transfer from the substrate because it will be abhesive to the substrate and will also transfer, dry, to a foreign surface because the image will have acquired pressure sensitive qualities and adherability by the mere act of passage through a heating chamber, after it has received the Xerographic image. These heating chambers usually exist within the Xerographic copier but they may be separate units as in the "Ricoh Plate Fuser Machine" made by Ricoh in Japan.

EXAMPLE 20

An abhesive sheet is first secured. This abhesive sheet is either prepared by coating as detailed, supra or is abhesive sui generis.

The abhesive sheet is next coated with what is here called a "HOT MELT PLASTICIZER" and which is here defined as a substance dry to the touch at room temperatures, and which is capable of melting at temperatures above room temperatures, and which in THE MOLTEN STATE can combine chemically and/or physically with a Xerographic image deposited from conventional Xerographic toner when such image is in a heat-softened state. After such combination has been effected the resulting toner image is unlike any conventional toner image in that it has acquired adhesive qualities. The "HOT MELT PLASTICIZER" (H.M.P.) is coated upon the abhesive sheet such that the thickness of the deposited coating can be 0.0003" to 0.003". The "H.M.P." coating may be applied from solution, from a liquid emulsion, from a hot-molten mass, or by the technique of "powder coating" where discrete powder particles are deposited and then flowed together by heat or pressure or both into a cohesive coating. The "H.M.P." varieties devised include:

| | |
|---|---|
| C12 | Fatty Acid with 0.5% Dow Corning Silicone Oil #200 |
| C14 | Fatty Acid with 0.75% Dow Corning Silicone Oil #200 |
| C16 | Fatty Acid with 0.9% Dow Corning Silicone Oil #200 |
| C18 | Fatty Acid with 1.5% Dow Corning Silicone Oil #200 plus 5% Dicyclo—hexyl phthalate. |

EXAMPLE 21

In this example the simplest method is shown. A single composition is coated upon a carrier sheet, and this formulation has a combination of abhesive and adhesive properties. The coated sheet is selectively abhesive to the substrate and simultaneously is selectively adhesive to the toner image.

The PURPOSE of this example is to secure a uniform coated product combining ab and ad properties, and to overcome one of the recurring problems with Example 20.

In Example 20 the second coating operation would generally scrape off to some extent, the first or abhesive coating, thus resulting in non-uniform quality of release in use. Some sections and some products would release readily and some sections would not release and would not transfer. In this example, a glassine paper (20 lb. approx.) was used as the substrate. This was coated with 0.0015" molten stearic acid and cooled to room temperature. This sheet was then fed through the Dennison BC14 copier using conventional toner. The copy, while hot upon emergence from the heating chamber of the copier, showed the stearic acid in molten condition being sucked into and amalgamated with the toner image. Upon cooling which took place rapidly, a finished dry-transfer sheet had been created. This experiment was repeated with the Jacob toner, with Red colored Jacob toner, with Blue colored Jacob toner with the same results. A clear differentiation between toners is possible in the Dennison Xerographic B.C. 14 copier, because it permits the removal of the entire Developer-Toner housing and replacement with another developer-toner housing containing a different toner. The entire developer-toner combination is uncontaminated. Additional formulations were tried to achieve this result. Such formulations consisted of the same formulations used in Example 20, except that the percentages of Dow Corning Silicone Oil were doubled, and the percentage of the dicyclohexyl phthalate had also been doubled where used. The reason is that where these additives were used in Example 20 there was no need for additional abhesiveness. The sheet was already abhesive. The additives were only to secure better running in the coating machine. In Example 21 it was imperative to increase the Silicone Oil because it is the sole abhesive donor. Perfect Dry Transfers were made. All the abhesive materials mentioned in the specification can be used.

Having set forth the invention hereinabove:

What is claimed is:

1. An electrophotographic process comprising forming an electrostatic image on a carrier sheet corresponding to information to be recorded, depositing a pattern of a toner composition on said carrier sheet thereby forming a raised pattern of said toner on said carrier sheet corresponding to said electrostatic image, the toner-image thereby formed comprising upper and lower surfaces, said lower surface being abhesive to said carrier sheet with which it is in contact and wherein said upper surface possesses adhesive characteristics whereby said toner-image may be directly transferred to a receptor surface brought into contact with said upper surface, said toner comprising an intumescent electroscopic powder mixture, comprising a thermoadhesive agent comprising microspheres carrying or containing adhesive.

2. The adhesive-containing microspheres of claim 1 further characterized by comprising an encapsulating shell and an inner core, said core comprising a tacky balsamic solid or a tacky liquid and said encapsulating shell comprising a thermoplastic, thermoadhesive material.

3. The adhesive-containing microspheres of claim 2 in which said shell consists of a styrene-acrylonitrile and said core consists of a polybutene tackifying liquid.

* * * * *